US007522012B2

(12) United States Patent
Wada

(10) Patent No.: US 7,522,012 B2
(45) Date of Patent: Apr. 21, 2009

(54) NONRECIPROCAL CIRCUIT DEVICE AND MANUFACTURING METHOD OF THE SAME

(75) Inventor: Takaya Wada, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/127,938

(22) Filed: May 28, 2008

(65) Prior Publication Data

US 2008/0218289 A1 Sep. 11, 2008

Related U.S. Application Data

(63) Continuation of application No. PCT/JP2007/071988, filed on Nov. 13, 2007.

(30) Foreign Application Priority Data

Jan. 18, 2007 (JP) ..... 2007-009489

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 5,776,275 A * 7/1998 Krishnamurthy et al. .... 156/150
6,559,732 B2 5/2003 Makino et al.

FOREIGN PATENT DOCUMENTS

| | | | |
|---|---|---|---|
| JP | 48-1724 | A | 1/1973 |
| JP | 61-136604 | U | 8/1986 |
| JP | 01-117501 | A | 5/1989 |
| JP | 01-117502 | A | 5/1989 |
| JP | 01-253302 | A | 10/1989 |
| JP | 2006-020051 | A | 1/2006 |
| JP | 2006-135419 | A | 5/2006 |
| WO | 2006/011383 | A1 | 2/2006 |

OTHER PUBLICATIONS

Official communication issued in the International Application No. PCT/JP2007/071988, mailed on Dec. 18, 2007.

* cited by examiner

*Primary Examiner*—Stephen E Jones
(74) *Attorney, Agent, or Firm*—Keating & Bennett, LLP

(57) ABSTRACT

A nonreciprocal circuit device includes permanent magnets, a ferrite to which a direct current magnetic field is applied by the permanent magnets, first and second central electrodes arranged on the ferrite, and a circuit substrate. A ferrite-magnet assembly mounted on the circuit substrate is covered with a resin layer. The resin layer includes an innermost layer made of a non-magnetic resin material and a magnetic resin layer having a magnetic filler mixed therein.

10 Claims, 6 Drawing Sheets

NONRECIPROCAL CIRCUIT DEVICE AND MANUFACTURING METHOD OF THE SAME

BACKGROUND OF THE INVENTION

1. Field of the Invention

The present invention relates to nonreciprocal circuit devices. In particular, the present invention relates to a nonreciprocal circuit device, such as an isolator and a circulator, preferably for use in a microwave band, and also relates to a manufacturing method of the nonreciprocal circuit device.

2. Description of the Related Art

Conventionally, nonreciprocal circuit devices, such as isolators and circulators, have a characteristic that allows signals to be transmitted only in a predetermined specific direction but not in the opposite direction. By making use of such characteristics, isolators, for example, are used in transmission circuits of mobile communication apparatus, such as automobile phones and portable phones.

In this type of nonreciprocal circuit device, to protect an assembly of a ferrite having a plurality of central electrodes and permanent magnets applying a direct-current magnetic field to the ferrite from an external magnetic field, the assembly is surrounded by a ring-shaped yoke (see, WO 2006/011383) or by a box-shaped yoke (see, Japanese Unexamined Patent Application Publication No. 2002-198707).

However, in a conventional nonreciprocal circuit device, a yoke obtained by processing a soft iron or other suitable material into a ring shape or a box-shaped yoke is used as a magnetic shield. Consequently, a significant amount labor and cost are required for the processing and assembly of the nonreciprocal circuit device.

SUMMARY OF THE INVENTION

To overcome the problems described above, preferred embodiments of the present invention provide a nonreciprocal circuit device having a simple structure with simple manufacturing processes and also having satisfactory electrical characteristics, and a manufacturing method of the nonreciprocal circuit device.

A nonreciprocal circuit device according to a preferred embodiment of the present invention includes permanent magnets, a ferrite to which a direct current magnetic field is applied by the permanent magnets, a plurality of central electrodes arranged on the ferrite, so as to be electrically insulated from each other and to intersect each other, and a circuit substrate having a terminal electrode on the surface thereof. In the nonreciprocal circuit device, the permanent magnets and the ferrite which are disposed on the circuit substrate are covered with a resin layer, and the resin layer includes at least an innermost layer made of a non-magnetic resin material and a magnetic resin layer having a magnetic filler mixed therein.

Preferably, the magnetic resin layer in the resin layer covering the permanent magnets and the ferrite provides a magnetic flux path, and a non-magnetic resin material is arranged as the innermost layer in the resin layer. Thus, a magnetic circuit is effectively provided in the magnetic resin layer without inducing a short circuit to the ferrite, and satisfactory electrical characteristics can be achieved. That is, no ring-shaped or box-shaped soft-iron yoke is required, as in a conventional nonreciprocal circuit device, and a magnetic circuit and a magnetic shielding effect can be provided with a simple arrangement, such as the resin layer.

The volume ratio of the filler to be mixed with resin is preferably about 5 vol % to about 50 vol %. A volume ratio below about 5 vol % impairs the capability of forming a magnetic path, and a volume ratio of more than about 50 vol % decreases the wettability of the filler with the resin, resulting in insufficient mechanical strength of the resin layer. Further, it is preferable that the filler is coated with a magnetic metal film, which increases the saturation magnetic flux density and, in particular, reduces insertion loss in a microwave band.

In addition, a tabular-shaped yoke made of a magnetic material may be arranged in the magnetic resin layer to increases magnetic efficiency. It is further preferable that this tabular-shaped yoke is coated with a magnetic material film.

In addition, the central electrodes include first and second central electrodes. It is possible to use a configuration in which one end of the first central electrode is connected to an input port and the other end is connected to an output port, while one end of the second central electrode is connected to the output port and the other end is connected to a ground port, in which a first matching capacitance is connected between the input port and the output port and a second matching capacitance is connected between the output port and the ground port, and in which a resistor is connected between the input port and the output port. Thus, a two-port lumped-constant isolator having a small insertion loss can be obtained.

Preferably, the first and second central electrodes are made of conductor films and arranged on the ferrite so as to be electrically insulated from each other and to intersect each other at a predetermined angle. This enables the first and second central electrodes to be stabilized with high precision by a thin-film forming technique, such as photolithography.

In addition, the ferrite and the permanent magnets define a ferrite-magnet assembly which is fixed from opposite sides by the permanent magnets substantially in parallel to surfaces having the central electrodes arranged thereon. The ferrite-magnet assembly may be disposed on the circuit substrate, such that the surfaces having the central electrodes arranged thereon are substantially perpendicular to the surface of the circuit substrate. Even if relatively large permanent magnets are used, the profile of the ferrite-magnet assembly is not increased, magnetic coupling between the central electrodes is increased, and thus, the electrical characteristics are improved.

A method for manufacturing a nonreciprocal circuit device according to another preferred embodiment of the present invention includes the steps of mounting permanent magnets and a ferrite on a mother substrate on the surface of which a plurality of circuit substrates are formed in a matrix at a location corresponding to each of the circuit substrates, covering the permanent magnets and the ferrite mounted on the mother substrate with a resin layer including at least an innermost layer made of a non-magnetic resin material and a magnetic resin layer having a magnetic filler mixed therein, and cutting the resin layer and the mother substrate into a predetermined size.

In the manufacturing method of a nonreciprocal circuit device according to this preferred embodiment of the present invention, the permanent magnets and the ferrite mounted on the mother substrate are covered with the resin layer and the resin layer and the mother substrate are cut off together. This enables production of a plurality of nonreciprocal circuit devices at the same time.

In particular, a magnetic resin layer sheet made of a non-magnetic resin material and a magnet resin layer sheet having a magnetic filler mixed therein are disposed over the permanent magnets and the sheets, heated, softened, and further cured. This arrangement facilitates processing of the sheets, and therefore the manufacturing process is simplified.

According to preferred embodiments of the present invention, permanent magnets and a ferrite mounted on a circuit substrate are covered with an innermost layer made of a non-magnetic resin material and a magnetic resin layer having a magnetic filler mixed therein. Thus, a conventional ring-shaped or box-shaped soft-iron yoke is not required, and a simple configuration is obtained. In addition, a magnetic circuit is effectively provided in the magnetic resin layer, and thus a nonreciprocal circuit device with satisfactory electrical characteristics is obtained. Moreover, the resin layer can be easily formed by filling or by processes of heating, softening, and further curing sheets. In addition, since the permanent magnets and the ferrite can be covered with the resin layer without a space (gap), the individual components will not be displaced due to shock caused by, for example, dropping, and a nonreciprocal circuit device having excellent mechanical strength is obtained.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIGS. 9A and 9B show explanatory drawings illustrating the flow of magnetic flux in a ferrite and a resin layer, in which FIG. 9A illustrates a case in which no innermost layer made of a non-magnetic resin material is provided, and FIG. 9B illustrates a case in which the innermost layer is provided.

DETAILED DESCRIPTION OF PREFERRED EMBODIMENTS

In the following, preferred embodiments of a nonreciprocal circuit device and a manufacturing method of the nonreciprocal circuit device according to the present invention will be described with reference to the accompanying drawings.

First Preferred Embodiment

Figure 1:
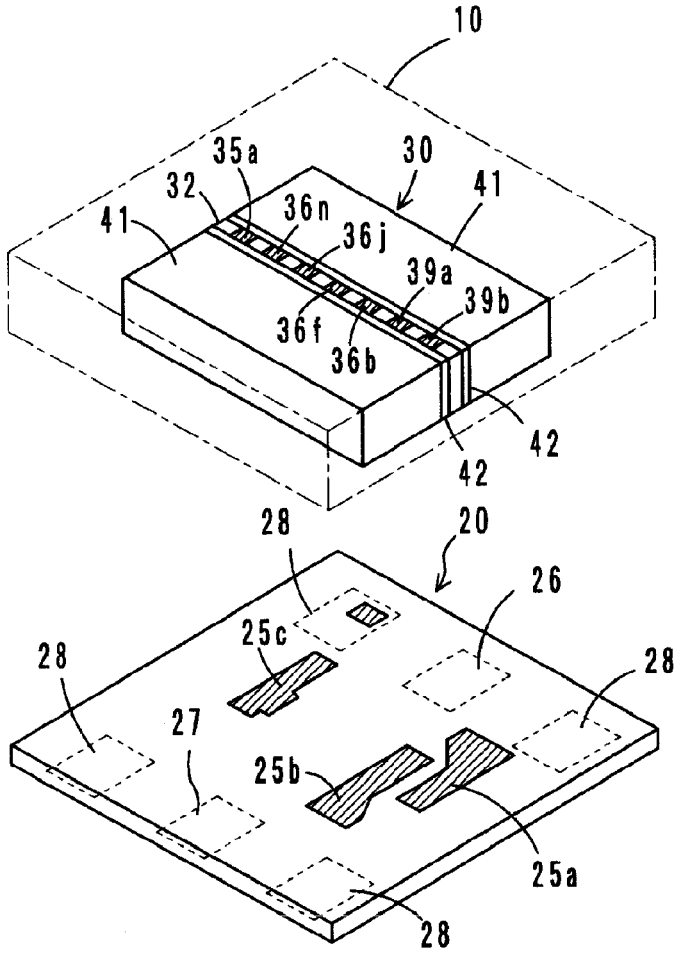
FIG. 1 is an exploded perspective view of a nonreciprocal circuit device (two-port isolator) according to a first preferred embodiment of the present invention.

FIG. 1 shows an exploded perspective view of a two-port isolator, which is a first preferred embodiment of a nonreciprocal circuit device according to the present invention. This two-port isolator is a lumped-constant isolator which includes a circuit substrate 20 a ferrite-magnet assembly 30 including a ferrite 32 and permanent magnets 41. The outer periphery of ferrite-magnet assembly 30 is covered with a resin layer 10. In FIG. 1, components indicated by oblique lines represent conductors.

Figure 2:
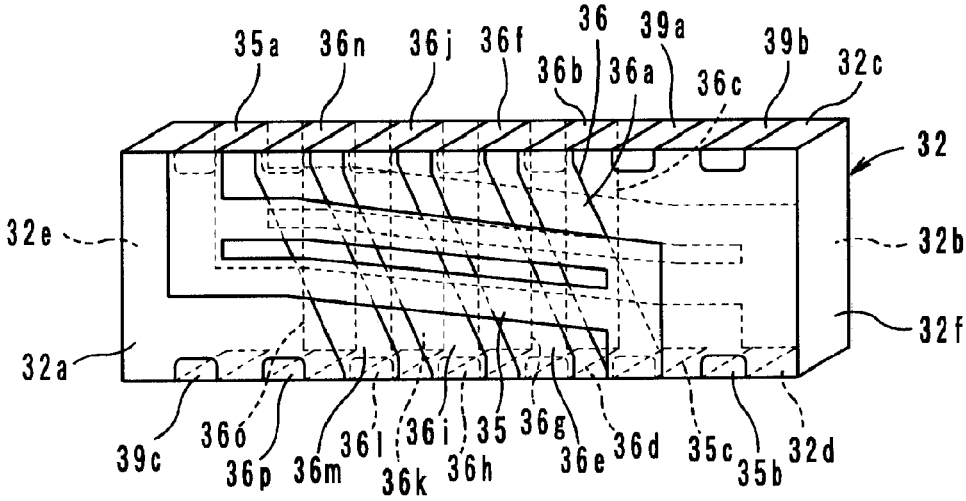
FIG. 2 is a perspective view illustrating a ferrite with central electrodes.

As illustrated in FIG. 2, the ferrite 32 has opposite principal surfaces 32*a* and 32*b* on which a first central electrode 35 and a second central electrode 36 electrically insulated from each other are provided. The ferrite 32 preferably has a substantially rectangular parallelepiped shape, for example, which includes the first principle surface 32*a* and the second principal surface 32*b* that are substantially parallel to each other, a top surface 32*c*, a bottom surface 32*d*, and end surfaces 32*e* and 32*f*.

Figure 4:
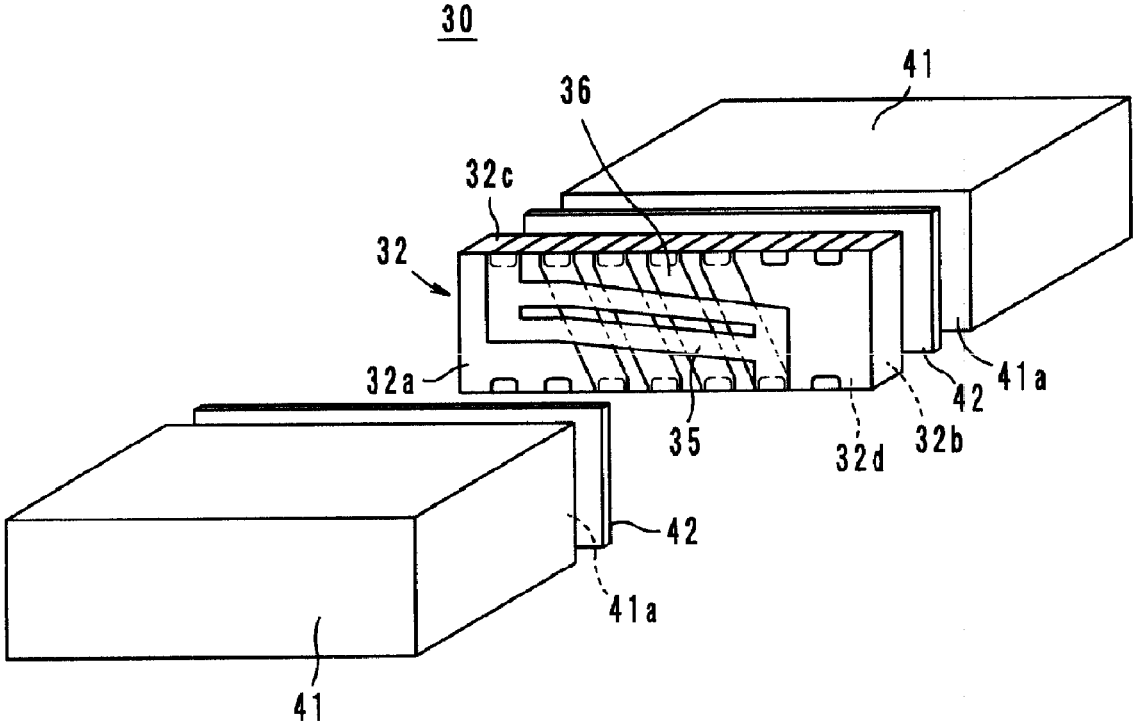
FIG. 4 is an exploded perspective view illustrating a ferrite-magnet assembly.

The permanent magnets 41 are bonded to the respective principal surfaces 32*a* and 32*b* via, for example, epoxy adhesive 42 to form the ferrite-magnet assembly 30 (see FIG. 4), such that a magnetic field is applied to the principal surfaces 32*a* and 32*b* of the ferrite 32 in a direction substantially perpendicular to the principal surfaces 32*a* and 32*b*. The permanent magnets 41 have principle surfaces 41*a* having substantially the same dimensions as the principal surfaces 32*a* and 32*b* of the ferrite 32. The principal surfaces 32*a* and 41*a* are arranged so as to face each other such that the outlines thereof correspond to each other, and the principal surfaces 32*b* and 41*a* are arranged so as to face each other such that the outlines thereof correspond to each other.

As illustrated in FIG. 2, the first central electrode 35 extends upward from a lower right portion of the principal surface 32*a* of the ferrite 32 and branches into two segments. The two segments extend obliquely in an upper left direction at a relatively small angle with respect to the longer sides. The first central electrode 35 then extends upward to an upper left portion and turns toward the second principal surface 32*b* via an intermediate electrode 35*a* on the top surface 32*c*. On the second principal surface 32*b*, the first central electrode 35 branches into two segments so as to overlap with those on the first principal surface 32*a* in perspective view. One end of the first central electrode 35 is connected to a connection electrode 35*b* provided on the bottom surface 32*d*, and the other end of the first central electrode 35 is connected to a connection electrode 35*c* provided on the bottom surface 32*d*. Thus, the first central electrode 35 is wound around the ferrite 32 by one turn. The first central electrode 35 and the second central electrode 36 to be described below have an insulating layer therebetween, so as to intersect each other in an insulated state.

The second central electrode 36 preferably includes a 0.5th-turn section 36*a* that extends in the upper left direction from approximately the midpoint of the bottom side of the first principal surface 32*a* at a relatively large angle with respect to the longer sides and intersects the first central electrode 35. The 0.5th-turn section 36*a* turns toward the second principal surface 32*b* via an intermediate electrode 36*b* on the top surface 32*c*. On the second principal surface 32*b*, the 1st-turn section 36*c* intersects the first central electrode 35 in a substantially perpendicular arrangement. A lower end portion of the 1st-turn section 36*c* turns toward the first principal surface 32*a* via an intermediate electrode 36*d* on the bottom surface 32*d*. On the first principal surface 32*a*, a 1.5th-turn section 36*e* extends substantially in parallel to the 0.5th-turn section 36*a* and intersects the first central electrode 35. The 1.5th-turn section 36*e* turns toward the second principal surface 32*b* via an intermediate electrode 36*f* on the top surface 32*c*. Likewise, the 2nd-turn section 36*g*, an intermediate electrode 36*h*, a 2.5th-turn section 36*i*, an intermediate electrode 36*j*, a 3rd-turn section 36*k*, an intermediate electrode 36*l*, a 3.5th-turn section 36*m*, an intermediate electrode 36*n*, and a 4th-turn section 36*o* are provided on the surfaces of the ferrite 32. In addition, the respective ends of the second central electrode 36 are connected to respective connection electrodes 35*c* and 36*p* provided on the bottom surface 32*d* of the ferrite 32. Note that the connection electrode 35*c* is commonly used as the connection electrode for the ends of the first central electrode 35 and the second central electrode 36.

That is, the second central electrode 36 is helically wound around the ferrite 32 by four turns. The number of turns is herein calculated by denoting one crossing of the central electrode 36 over the first principal surface 32*a* or the second principal surface 32*b* as a 0.5 turn. The intersecting angle between the central electrodes 35 and 36 is set as required, so that an input impedance and insertion loss are adjusted.

Figure 3:
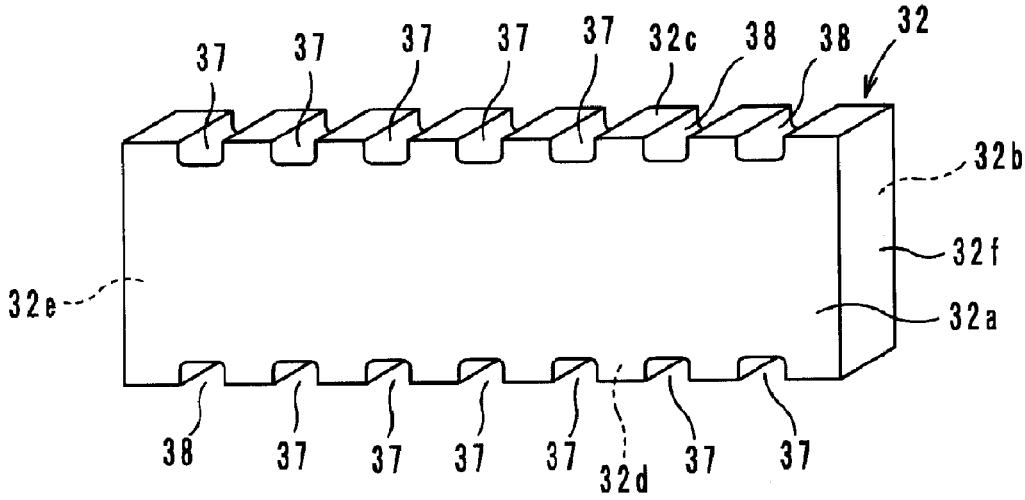
FIG. 3 is a perspective view illustrating the ferrite.

The connection electrodes 35*b*, 35*c*, 36*p* and the intermediate electrodes 35*a*, 36*b*, 36*d*, 36*f*, 36*h*, 36*j*, 36*l*, and 36*n* are formed by filling recesses 37 (see FIG. 3) provided on the top and bottom surfaces 32*c* and 32*d* of the ferrite 32 with electrode conductors, such as silver, a silver alloy, copper, and a copper alloy or by applying the electrode conductors to the recesses 37. In addition, on the top and bottom surfaces 32*c* and 32*d*, dummy recesses 38 are also formed substantially in parallel to the above-described electrodes and dummy electrodes 39*a*, 39*b*, and 39*c* are formed therein. These types of electrode are formed by providing through-holes in a mother ferrite substrate, filling the through-holes with electrode conductors, and then cutting the substrate along sections at which the through-holes are to be cut. It is also possible to form these electrodes as conductor layers in the recesses 37 and 38.

As a ferrite 32, a YIG ferrite or other suitable ferrite material may be used. Each of the first and second central electrodes 35 and 36 and the other various electrodes can be formed as a thick film or a thin film composed of silver or a silver alloy by a process such as printing, transferring, and photolithography. For the insulating film between the central electrodes 35 and 36, a thick dielectric film of glass or alumina, a polyimide resin film, or other suitable insulating material can be used. These films can also be formed by a process, such as printing, transferring, and photolithography.

Typically, strontium, barium, or lanthanum-cobalt ferrite magnets are used as the permanent magnets 41. For the adhesive 42 for bonding the permanent magnets 41 to the ferrite 32, a one-part thermosetting epoxy adhesive is preferably used. This adhesive enables efficient processing at room temperature and is well permeated into the joints, and forming a thin layer of about 5 μm to about 25 μm to provides tight fit. In addition, having heat resistance and weather resistance, the adhesive is not melted or peeled by reflow heat and has satisfactory reliability against heat and humidity.

The circuit substrate 20 is a sintered multilayer substrate defined by a laminate of a plurality of dielectric sheets and predetermined electrodes provided thereon. In the interior of the circuit substrate 20, as illustrated in equivalent circuits in FIG. 5 and FIG. 6, matching capacitors C1, C2, Cs1, Cs2, Cp1, and Cp2, and a terminating resistor R are provided. In addition, terminal electrodes 25*a*, 25*b*, and 25*c* are provided on the top surface of the circuit substrate 20, and external-connection terminal electrodes 26, 27, and 28 are provided on the bottom surface of the circuit substrate 20.

Figure 5:
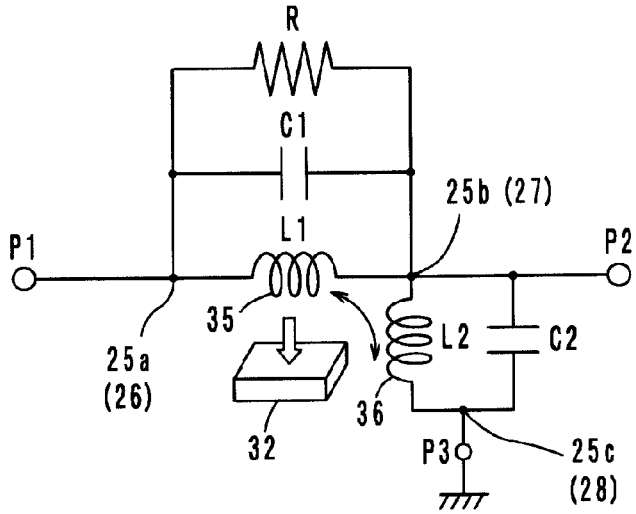
FIG. 5 is an equivalent circuit diagram illustrating a first circuit example of a two-port isolator.
Figure 6:
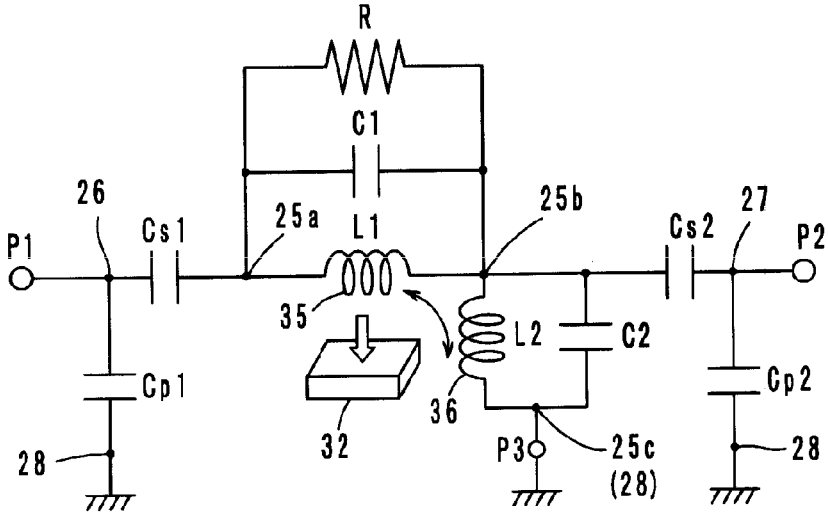
FIG. 6 is an equivalent circuit diagram illustrating a second circuit example of a two-port isolator.

The connection relationships among these matching circuit components and the first and second central electrodes 35 and 36 are illustrated in a first circuit example in FIG. 5 and a second circuit example in FIG. 6, for example. In the following, the relationships will be described based on the second circuit example shown in FIG. 6.

The external-connection terminal electrode 26 provided on the bottom surface of the circuit substrate 20 functions as an input port P1. This external electrode 26 is connected to the matching capacitor C1 and the terminating resistor R via the matching capacitor Cs1. In addition, this electrode 26 is connected to one end of the first central electrode 35 via the terminal electrode 25*a* provided on the top surface of the circuit substrate 20 and the connection electrode 35*b* provided on the bottom surface 32*d* of the ferrite 32.

The other end of the first central electrode 35 and one end of the second central electrode 36 are connected to the terminating resistor R and the capacitors C1 and C2 via the connection electrode 35*c* provided on the bottom surface 32*d* of the ferrite 32 and the terminal electrode 25*b* provided on the top surface of the circuit substrate 20. The other end of the first central electrode 35 and the one end of the second central electrode 36 are also connected to the external-connection terminal electrode 27 provided on the bottom surface of the circuit substrate 20 via the capacitor Cs2. This electrode 27 functions as an output port P2.

The other end of the second central electrode 36 is connected to the capacitor C2 and the external-connection terminal electrode 28 provided on the bottom surface of the circuit substrate 20 via the connection electrode 36*p* provided on the bottom surface 32*d* of the ferrite 32 and the terminal electrode 25*c* provided on the top surface of the circuit substrate 20. This electrode 28 functions as a ground port P3.

A connection point between the input port P1 and the capacitor Cs1 is connected to the capacitor Cp1 for impedance adjustment that is connected to ground. Similarly, a connection point between the output port P2 and the capacitor Cs2 is connected to the capacitor Cp2 for impedance adjustment that is connected to ground.

The ferrite-magnet assembly 30 is arranged on the circuit substrate 20 so that the various electrodes on the bottom surface 32*d* of the ferrite 32 are bonded to the terminal electrodes 25*a* and 25*b*, and 25*c* on the circuit substrate 20 by reflow soldering, and the bottom surfaces of the permanent magnets 41 are bonded to the circuit substrate 20 with adhesive.

Figure 7:
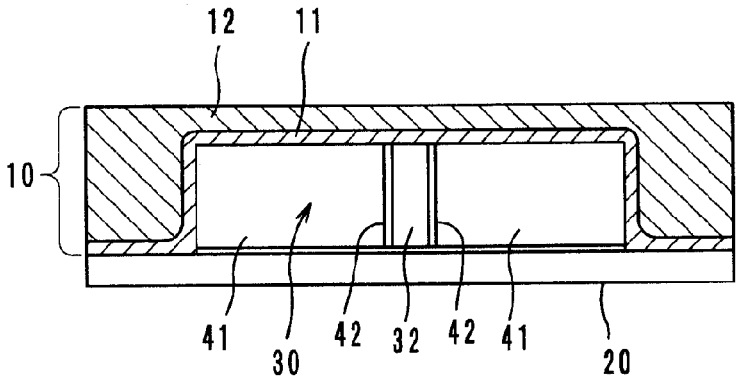
FIG. 7 is a cross-sectional view of a two-port isolator.

As illustrated in FIG. 7, the resin layer 10 includes an innermost layer 11 made of a nonmagnetic resin material and a magnetic resin layer 12 having a magnetic filler mixed therein. The innermost layer 11 made of a nonmagnetic resin material is selected from epoxy resin, silicon resin, acrylic resin, polyimide resin, ultra-violet curable resin, and other suitable resins. In this preferred embodiment, epoxy resin is used. Preferably, the thickness of the innermost layer 11 is at least about 50 μm, which prevents short circuiting of the magnetic circuit, as will be described below. The magnetic resin layer 12 preferably is a mixture of the nonmagnetic resin material and a magnetic filler (for example, ferromagnetic powder having high saturation magnetization and low coercivity, such as Fe, Fe—Si, Fe—Si—Al, Fe—Ni, and a soft ferrite). In this preferred embodiment, Fe is preferably used, for example.

Figure 8A:
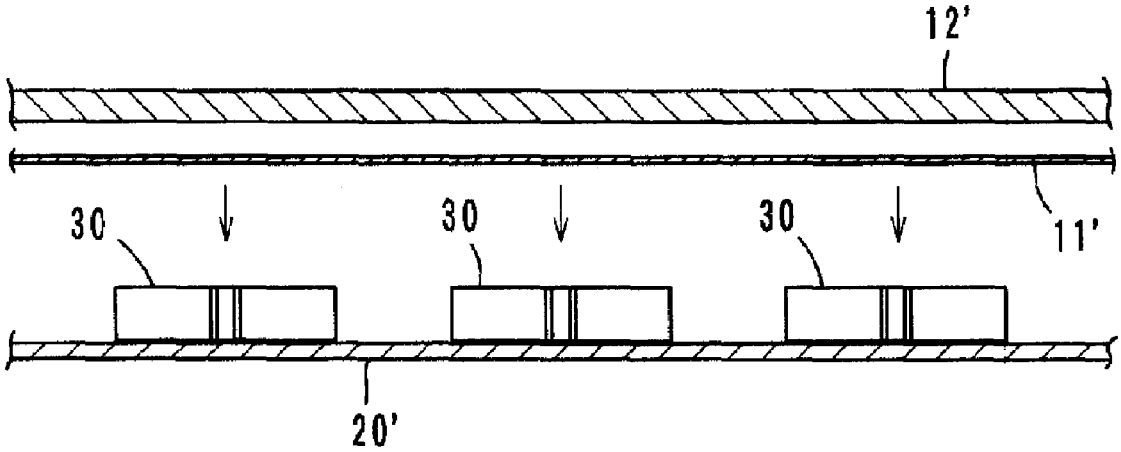
FIGS. 8A to 8C show explanatory drawings illustrating processes of forming a resin layer.
Figure 8B:
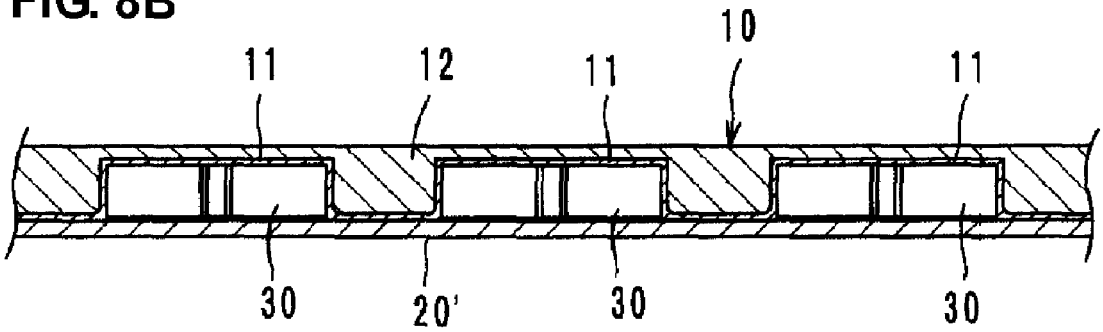
Figure 8C:
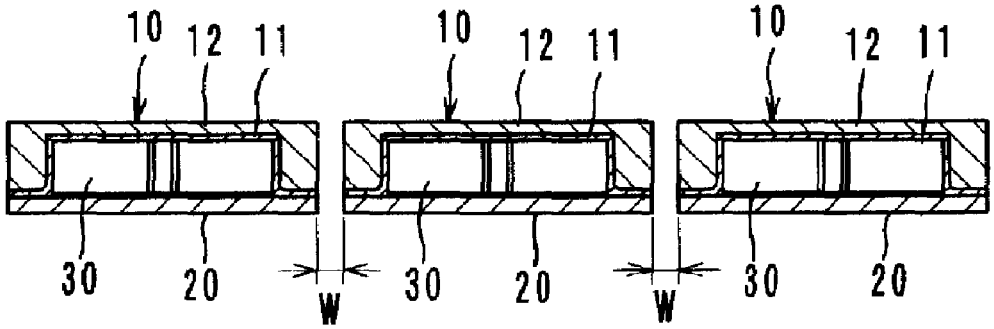

In a first method for providing the resin layer 10, as illustrated in FIG. 8A, the ferrite-magnet assembly 30 is mounted on a mother substrate 20' on which a plurality of circuit substrates are formed in a matrix, and a non-magnetic resin tape 11' and a magnetic resin tape 12' are disposed over the ferrite-magnet assembly 30. Then, the tapes 11' and 12' are heated, softened and further cured, resulting in the resin layer 10 including the innermost layer 11 and the magnetic resin layer 12 (see FIG. 8B). Then, the resin layer 12 and the mother substrate 20' are cut into an intended size (see FIG. 8C). The dicing width W is preferably about 0.15 mm. With such a manufacturing method illustrated in FIGS. 8A to 8C, a plurality of isolators can be produced at the same time.

When the magnetic resin tape 12' is softened, preferably, the upper surface of the tape 12' is pressed with a flat plate (not shown) so that a surface of the magnetic resin layer 12 is substantially flat. This is because the surface of the magnetic resin layer 12 is used to pick up the isolator to be mounted on a substrate (not shown) using a chip mounter.

As a second method for providing the resin layer 10, it is also possible to apply the innermost layer 11 to the outer peripheral surface of the ferrite-magnet assembly 30 mounted on the circuit substrate 20 and then add the magnetic resin layer 12 as filling. In the first method described above the tapes 11' and 12' are arranged and then the tape is heating. Therefore, the first method facilitates manufacturing as compared to the second method.

Figure 9A:
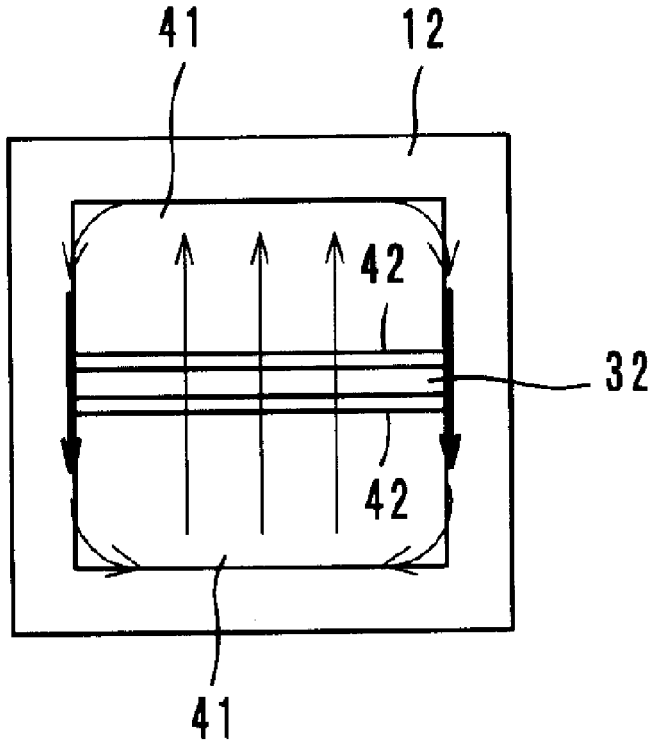
Figure 9B:
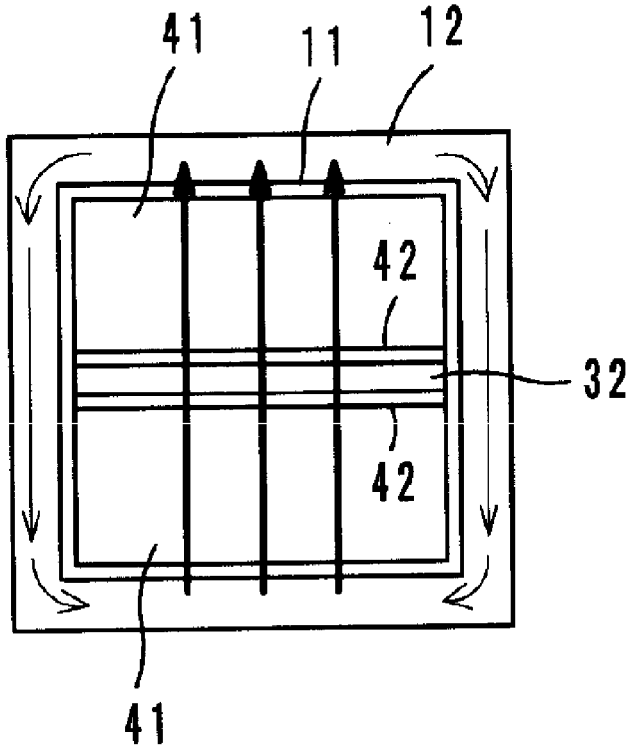

In the following, the action of the resin layer 10 including the innermost layer 11 and the magnetic resin layer 12 will be described with reference to FIGS. 9A and 9B. In each of FIGS. 9A and 9B, arrows indicate the direction of magnetic flux. FIG. 9A illustrates a case in which the innermost layer 11 is not provided and only the magnetic resin layer 12 is provided. In this case, since the magnetic resin layer 12 is in contact with the ferrite 32 and the permanent magnets 41, the magnetic circuit is short-circuited, and the internal magnetic field is reduced. On the other hand, when the innermost layer 11 including a non-magnetic resin is provided as illustrated in FIG. 9B, the short circuiting is prevented because of a large magnetic resistance of the innermost layer 11. Thus, a large magnetic field is provided in the interior of the ferrite 32. This enhances the electrical characteristics as an isolator and causes the magnetic resin layer 12 to provide a magnetic shielding effect.

In the magnetic resin layer 12, the volume ratio of the filler to be mixed in the resin is preferably about 5 vol % to about 50 vol %. In this preferred embodiment, the volume ratio is about 15 vol %. A volume ratio below about 5 vol % makes it substantially impossible to form a magnetic path, and a volume ratio more than about 50 vol % decreases the wettability of the filler with the resin, resulting in insufficient mechanical strength of the resin layer 12.

In addition, it is preferable that the filler is coated with a magnetic metal film so that the saturation magnetic flux density of the resin layer 12 is increased. The magnetic metal film is composed of Au, Ag, Cu, or Al, for example. In this preferred embodiment, the filler is coated with Cu. An induced current is generated in the direction substantially perpendicular to microwave signals, which increases insertion loss. When the surface of the filler is treated with a highly conductive (low electrical resistance) material, the insertion loss caused by the effect of the induced current is reduced.

Note that while it is not necessary to connect the magnetic resin layer 12 to ground, the magnetic resin layer 12 may be connected to ground by soldering, by a conductive adhesive, or by other suitable connection methods so that the high-frequency shielding effect is improved.

In the two-port isolator having the above-described configuration, one end is connected to the input port P1 and the other end is connected to the output port P2, while one end of the second central electrode 36 is connected to the output port P2 and the other end is connected to the ground port P3. With this arrangement, a two-port lumped-constant isolator having low insertion loss is obtained. Further, in operation, a large high-frequency current flows through the second central electrode 36 and a small high-frequency current flows through the first central electrode 35. Therefore, the direction of a high-frequency magnetic field generated by the first central electrode 35 and the second central electrode 36 is determined by the location of the second central electrode 36. Once the direction of the high-frequency magnetic field is determined, processes for reducing the insertion loss are facilitated.

Further, with the arrangement in which the ferrite 32 and a pair of the permanent magnets 41 are connected with the adhesive 42, the ferrite-magnet assembly 30 is mechanically stabilized, and thus, a durable isolator that is not deformed or damaged due to vibration or shock is obtained.

In the present isolator, the circuit substrate 20 preferably is a multilayer dielectric substrate. Thus, circuitry including a capacitor and a resistor can be mounted in the interior of the circuit substrate 20. This enables a decrease in the size and the thickness of the isolator. In addition, increased reliability is provided since the circuit elements are preferably connected in the interior of the substrate. However, the circuit substrate 20 is not necessarily multi-layered, and may be single-layered, and a chip-type resistor and a chip-type matching capacitor may be mounted externally on the circuit substrate.

Second Preferred Embodiment

Figure 10:
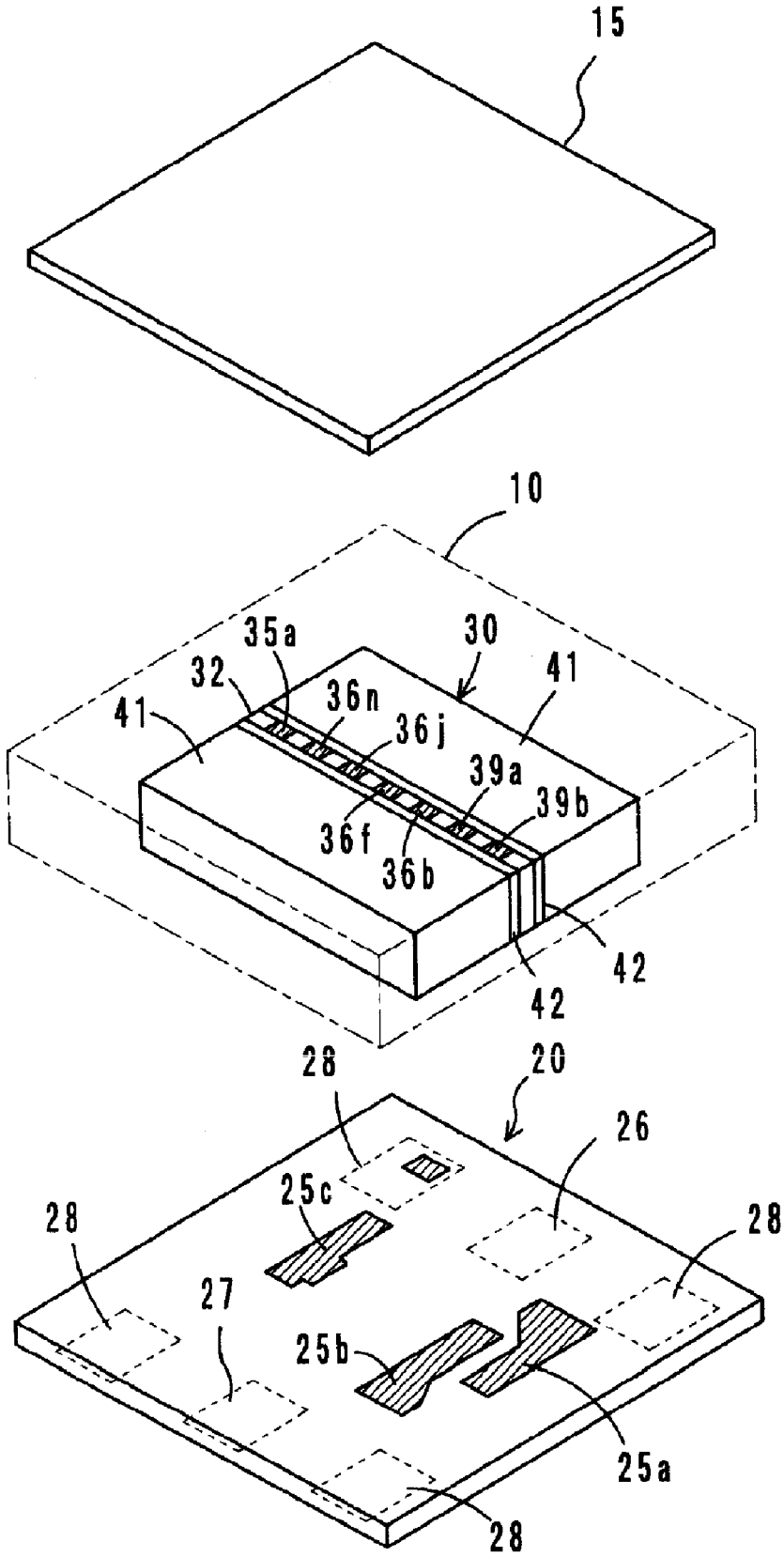
FIG. 10 is an exploded perspective view illustrating a nonreciprocal circuit device (two-port isolator) according to a second preferred embodiment of the present invention.

FIG. 10 shows an exploded perspective view of a two-port isolator according to a second preferred embodiment of the present invention. This two-port isolator preferably has a configuration that is similar to the first preferred embodiment, but is different from the first preferred embodiment in that it includes a tabular-shaped yoke 15 made of a magnetic material on an outer resin layer 12 defining a resin layer 10. Other than this arrangement, the configuration of the two-port isolator is similar to that of the first preferred embodiment, and a redundant description thereof is omitted.

The tabular-shaped yoke 15 may be embedded in the surface of the magnetic resin layer 12 or may be disposed on the surface of the magnetic resin layer 12. A magnetic circuit and magnetic shielding effect provided by the magnetic resin layer 12 are enhanced. In particular, leakage of magnetic flux to the outside can be prevented even when the amount of a filler mixed in the magnetic resin layer 12 is relatively small.

Preferably, the tabular-shaped yoke 15 is made of a magnetic material, such as a soft-iron steel plate, a silicon steel plate, and a pure-iron plate, and the surface of the tabular-shaped yoke 15 is coated with a magnetic metal film. The magnetic metal film may be formed as a plating film of, for example, Au, Ag, Cu, or Al. A soft-iron steel plate, a silicon steel plate, and a pure-iron plate have a large magnetic shielding effect due to a large saturation magnetic flux density and small residual magnetic flux density. Thus, these materials are preferable in that the residual magnetic flux density of permanent magnets 41 can be easily adjusted and stabilized.

Other Preferred Embodiments

The nonreciprocal circuit device and the manufacturing method of the nonreciprocal circuit device according to the present invention are not limited the above-described preferred embodiments and may be modified within the scope of the present invention.

In particular, the structure of a resin layer 10 is not limited to a two-layer structure including an innermost layer 11 and a magnetic resin layer 12, and the magnetic resin layer 12 may include a plurality of layers. In addition, a chip-type terminating resistor R, chip-type capacitors C1 and C2, and other components may be mounted on a circuit substrate 20 and covered with the resin layer 10.

In addition, the present invention is not limited to a two-port isolator having a ferrite-magnet assembly 30 and may be a circulator. Other configurations may be used for a ferrite and permanent magnets, and a central electrode is not limited to a central electrode made of a conductor film.

As described above, the present invention is useful in a nonreciprocal circuit device and is particularly advantageous in that it has a simple structure enabling easy manufacturing, and in addition, in that it has satisfactory electrical characteristics.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A nonreciprocal circuit device comprising:

permanent magnets;

a ferrite to which a direct current magnetic field is applied by the permanent magnets;

a plurality of central electrodes disposed on the ferrite, the central electrodes being electrically insulated from each other and intersecting each other; and a circuit substrate having a terminal electrode disposed on a surface thereof; wherein the permanent magnets and the ferrite which are disposed on the circuit substrate are covered with a resin layer; and the resin layer includes at least an innermost layer made of a non-magnetic resin material and a magnetic resin layer having a magnetic filler mixed therein.

2. The nonreciprocal circuit device of claim 1, wherein a volume ratio of the filler mixed in the magnetic resin layer is about 5 vol % to about 50 vol %.

3. The nonreciprocal circuit device of claim 1, wherein the filler is coated with a magnetic metal film.

4. The nonreciprocal circuit device of claim 1, wherein the ferrite and the permanent magnets define a ferrite-magnet assembly in which the permanent magnets are fixed to opposite sides of the ferrite substantially in parallel to surfaces of the ferrite having the central electrodes arranged thereon; and the ferrite-magnet assembly is disposed on the circuit substrate such that the surfaces having the central electrodes arranged thereon are substantially perpendicular to the surface of the circuit substrate.

5. The nonreciprocal circuit device of claim 1, wherein a tabular-shaped yoke made of a magnetic material is arranged on the magnetic resin layer.

6. The nonreciprocal circuit device of claim 5, wherein the tabular-shaped yoke is coated with a magnetic material film.

7. The nonreciprocal circuit device of claim 1, wherein the central electrodes include a first central electrode and a second central electrode, one end of the first central electrode is electrically connected to an input port and the other end of the first central electrode is electrically connected to an output port, and one end of the second central electrode is electrically connected to the output port and the other end of the second central electrode is electrically connected to a ground port;

a first matching capacitor is electrically connected between the input port and the output port;

a second matching capacitor is electrically connected between the output port and the ground port; and a resistor is electrically connected between the input port and the output port.

8. The nonreciprocal circuit device of claim 7, wherein the first and second central electrodes include conductor films and are disposed on the ferrite.

9. A method for manufacturing a nonreciprocal circuit device including permanent magnets, a ferrite to which a direct current magnetic field is applied by the permanent magnets, a plurality of central electrodes arranged on the ferrite, the central electrodes being electrically insulated from each other and intersecting each other, and a circuit substrate having a terminal electrode on a surface thereof, the method comprising the steps of:

mounting the permanent magnets and the ferrite on a mother substrate on a surface of which a plurality of the circuit substrates are formed in a matrix, at a location corresponding to each of the plurality of circuit substrates;

covering the permanent magnets and the ferrite mounted on the mother substrate with a resin layer including at least an innermost layer made of a non-magnetic resin material and a magnetic resin layer having a magnetic filler mixed therein; and subsequently cutting the resin layer and the mother substrate into a predetermined size.

10. The method for manufacturing a nonreciprocal circuit device of claim 9, wherein in the covering step, an innermost layer sheet made of a non-magnetic material and a magnetic resin layer sheet having a magnetic filler mixed therein are disposed over the permanent magnets and the ferrite, and are then heated, softened, and further cured.

* * * * *